US011618541B2

(12) United States Patent
Neathery et al.

(10) Patent No.: US 11,618,541 B2
(45) Date of Patent: Apr. 4, 2023

(54) CONTROL SYSTEM AND METHOD FOR CONTROLLING MARINE VESSELS

(71) Applicant: Caterpillar Inc., Peoria, IL (US)

(72) Inventors: Brian Philip Neathery, Hockley, TX (US); Cameron Scott Gandy, Houston, TX (US)

(73) Assignee: Caterpillar Inc., Peoria, IL (US)

( * ) Notice: Subject to any disclaimer, the term of this patent is extended or adjusted under 35 U.S.C. 154(b) by 30 days.

(21) Appl. No.: 17/443,185

(22) Filed: Jul. 22, 2021

(65) Prior Publication Data

US 2023/0028299 A1 Jan. 26, 2023

(51) Int. Cl.
*B63H 21/21* (2006.01)
*F02D 29/02* (2006.01)
(Continued)

(52) U.S. Cl.
CPC ..... *B63H 21/21* (2013.01); *B63B 17/00* (2013.01); *F02D 29/02* (2013.01); *F02D 41/0215* (2013.01); *F02D 41/062* (2013.01); *F02N 1/00* (2013.01); *B63H 23/02* (2013.01); *B63H 23/30* (2013.01); *B63H 2021/216* (2013.01); *F02D 2200/101* (2013.01)

(58) Field of Classification Search
CPC .. B63H 21/21; B63H 23/30; B63H 2021/216; B63B 17/00; F02D 29/02; F02D 41/0215; F02D 41/062; F02D 2200/101; F02N 1/00
See application file for complete search history.

(56) References Cited

U.S. PATENT DOCUMENTS 3,315,584 A * 4/1967 Van Ranst ..... B63B 43/00 114/211
3,465,665 A * 9/1969 O'Day ..... F02P 11/06 454/78
(Continued)

FOREIGN PATENT DOCUMENTS

JP 2903757 B2 6/1999
JP 2006345410 A 12/2006

OTHER PUBLICATIONS

Written Opinion and International Search Report for Int'l. Patent Appln. No. PCT/US2022/036201, dated Dec. 15, 2022 (11 pgs).

*Primary Examiner* — Carl C Staubach

(57) ABSTRACT

Control system for controlling operations of a marine vessel having a first engine and a second engine is provided. Parity switches are operable to start/stop first and second engine. Each parity switch is actuated for first time to activate remote start/stop control of respective engine. Each switch is actuated for second time to switch respective engine to ON or OFF state. Operator console is communicatively coupled to parity switches to receive first and/or second user inputs. Propulsion control unit is communicably coupled to operator console via network communication channel, first engine control unit of first engine and second engine control unit of second engine. Propulsion control unit receives operational parameters for engines from engine control units and receives first and second user inputs from operator console. Propulsion control unit transmits engine operating signals for operating respective engines in response to first and/or second user input and based on operational parameters.

20 Claims, 10 Drawing Sheets

(51) Int. Cl.

| | |
|---|---|
| ***F02D 41/02*** | (2006.01) |
| ***F02D 41/06*** | (2006.01) |
| ***B63B 17/00*** | (2006.01) |
| ***F02N 1/00*** | (2006.01) |
| *B63H 23/02* | (2006.01) |
| *B63H 23/30* | (2006.01) |

(56) References Cited

U.S. PATENT DOCUMENTS 4,250,358 A * 2/1981 Gilbertson ..... B63H 21/21 200/543
4,836,809 A * 6/1989 Pelligrino ..... B63H 21/22 440/86
5,062,516 A * 11/1991 Prince ..... B63H 21/213 74/480 B
5,352,138 A * 10/1994 Kanno ..... B63H 21/21 74/480 B
5,353,730 A * 10/1994 Talbot ..... B63B 35/70 114/77 R
5,539,294 A * 7/1996 Kobayashi ..... B63H 21/213 318/553
6,280,269 B1 * 8/2001 Gaynor ..... B63H 21/213 440/86
6,755,703 B1 * 6/2004 Erickson ..... F16H 61/30 440/75
6,789,519 B1 * 9/2004 Bell ..... F02N 11/0807 123/179.2
7,392,464 B1 * 6/2008 Feng ..... H03M 13/09 714/701
7,467,595 B1 * 12/2008 Lanyi ..... B63H 25/02 114/144 R
7,524,218 B2 4/2009 Okuyama
7,540,795 B2 6/2009 Okuyama et al.
8,162,703 B2 4/2012 Bamba
9,043,057 B2 5/2015 Iwata et al.
9,067,664 B2 * 6/2015 Yuet ..... B63H 25/42
9,868,501 B1 1/2018 Gable et al.
9,878,769 B2 1/2018 Kinoshita et al.
10,343,759 B2 * 7/2019 Despineux ..... B63H 21/213
10,562,602 B1 * 2/2020 Gable ..... B63H 25/42
D890,678 S * 7/2020 Neathery ..... D12/317
11,257,378 B2 * 2/2022 Derginer ..... G05D 1/0208
2007/0227429 A1 * 10/2007 Okuyama ..... B63B 49/00 114/146
2007/0282490 A1 * 12/2007 Ito ..... B63H 21/21 701/2
2007/0293102 A1 * 12/2007 Okuyama ..... B63H 21/213 440/1
2008/0003898 A1 * 1/2008 Watanabe ..... B63H 21/213 701/2
2008/0160845 A1 * 7/2008 Kado ..... B63H 21/22 440/1
2010/0250036 A1 9/2010 Bamba et al.
2011/0196553 A1 8/2011 Garon et al.
2021/0135459 A1 * 5/2021 Converse ..... H02J 3/12

* cited by examiner

CONTROL SYSTEM AND METHOD FOR CONTROLLING MARINE VESSELS

TECHNICAL FIELD

The present disclosure generally relates to marine vessels and more particularly, to a control system and method for controlling operations of the marine vessels.

BACKGROUND

Marine vessels are known to have multiple engines, such as a port engine and a starboard engine, that are operable to propel the vessel. Generally, controlling the start and stop operations of each of these engines is done by specific start and stop buttons provided for each of these engines, such as in a deck of the vessel. Such start-stop functionality is, conventionally, facilitated by either integrating third party systems and/or by implementing complex wired connections to connect the individual engines with their respective start and stop switches in the deck. However, such implementations have numerous disadvantages. For instance, complex wired connections are obviously tedious, complicated, and expensive to implement and may be even more difficult if the size of the marine vessel increases. Additionally, using third party systems may often be undesirable for their deployment and cost related issues.

U.S. Pat. No. 9,878,769 (hereinafter referred to as the '769 patent) provides a watercraft that includes a plurality of devices, a central controller, and a display device. The central controller is programmed to execute centralized control of the devices. The display device includes a touch panel function. The display device is configured to communicate with the central controller, and to display information regarding watercraft in a Graphical User Interface (GUI) format.

SUMMARY OF THE INVENTION

In one aspect, a control system for controlling operations of a marine vessel having a first engine and a second engine operable to propel the marine vessel is provided. The control system includes a first parity switch operable to start and stop the first engine and a second parity switch operable to start and stop the second engine, Each of the first parity switch and the second parity switch is configured to be actuated for a first time for a first time period to receive a first user input to activate a remote start/stop control of the respective one of the first engine and the second engine. Each of the first parity switch and the second parity switch is configured to be actuated for a second consecutive time for a second time period to receive a second user input to switch the respective one of the first engine and the second engine to one of an ON state and an OFF state. The control system includes an operator console positioned in a deck of the marine vessel. The operator console is communicatively coupled to each of the first parity switch and the second parity switch to receive one or more of the first user input and the second user input from the respective first parity switch and the second parity switch. Further, the control system includes a propulsion control unit communicably coupled to the operator console via a network communication channel, a first engine control unit associated with the first engine and a second engine control unit associated with the second engine. The propulsion control unit is configured to receive one or more of operational parameters associated with each of the first engine and the second engine from the respective first engine control unit and the second engine control unit. The propulsion control unit further receives the second user input from each of the first parity switch and the second parity switch via the operator console. Furthermore, the propulsion control unit is configured to transmit one or more engine operating signal for operating each of the first engine and the second engine to the respective first engine control unit and the second engine control unit. The one or more engine operating signal is in response to the first and/or the second user input and the received one or more engine operational parameters.

In another aspect, a method for controlling operations of a marine vessel, having a first engine and a second engine operable to propel the marine vessel, is provided. The method includes operating a first parity switch to start and stop the first engine and a second parity switch to start and stop the second engine. Operating each of the first parity switch and the second parity switch includes actuating the respective first parity switch and the second parity switch for a first time and for a first time period to receive a first user input to activate a remote start/stop control of the respective one of the first engine and the second engine. Further, operating the parity switches further includes actuating the respective first parity switch and the second parity switch for a second time and for a second time period to receive a second user input to switch the respective one of the first engine and the second engine to one of an ON state and an OFF state. The method includes receiving, by an operator console positioned in a deck of the marine vessel, one or more of the first user input and the second user input from the respective first parity switch and the second parity switch. Further, the method includes receiving, by the propulsion control unit from the operator console over a network communication channel, one or more of the first user input and the second user input from each of the first parity switch and the second parity switch. Furthermore, the method includes receiving, by the propulsion control unit, one or more operational parameters associated with each of the first engine and the second engine from a respective first engine control unit associated with the first engine and a second engine control unit associated with the second engine. Additionally, the method includes transmitting, by the propulsion control unit, one or more engine operating signals for operating each of the first engine and the second engine to the respective first engine control unit and the second engine control unit. The one or more engine operating signals are in response to the one or more first user input and the second user input and are based on the received one or more engine operational parameters.

DETAILED DESCRIPTION

Figure 1:
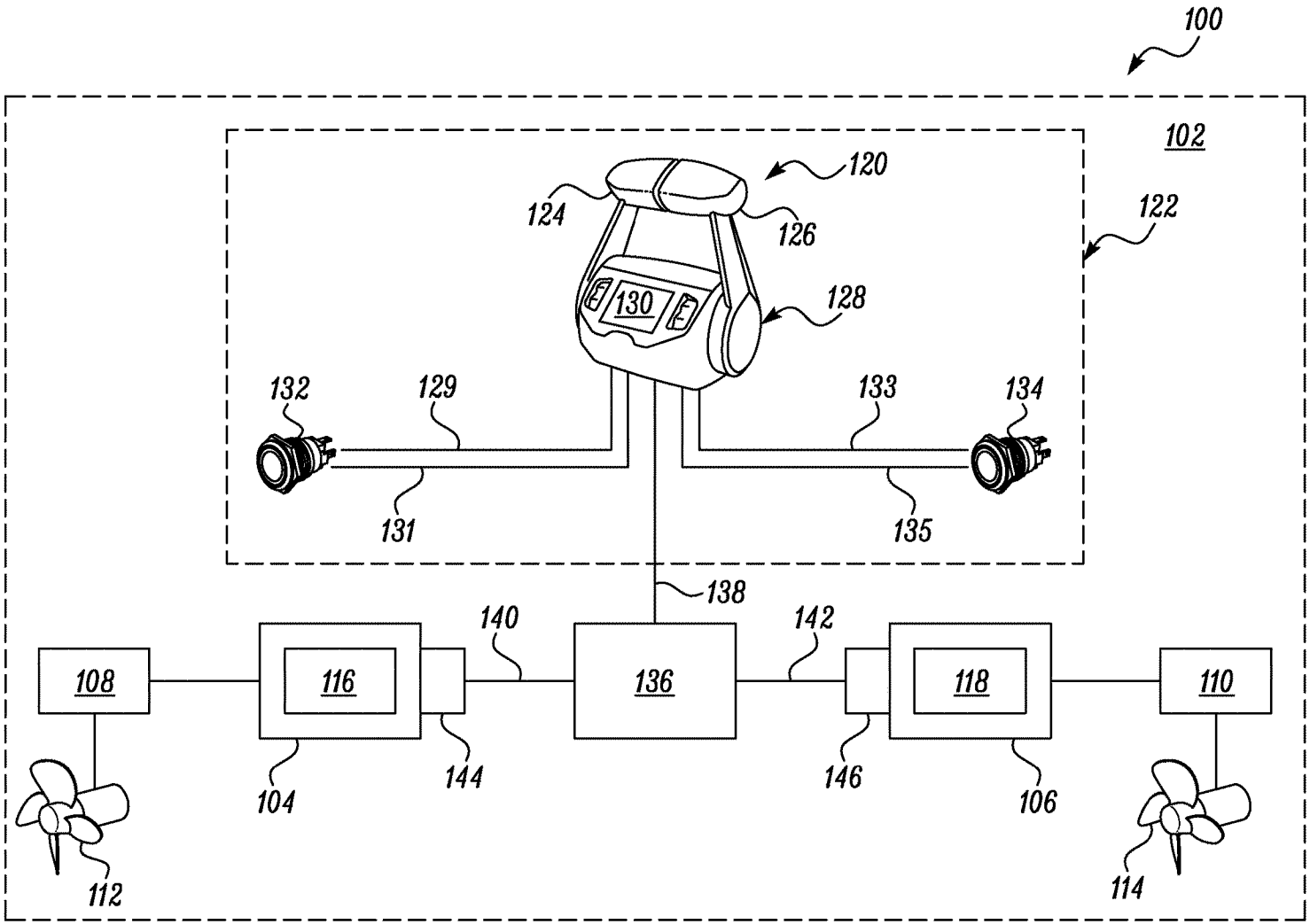
FIG. 1 illustrates a simplified schematic of an exemplary control system for controlling a marine vessel, according to the embodiments of the present disclosure.

The present disclosure relates to a system and method for controlling operations of a marine vessel. To this end, FIG. 1 illustrates a schematic diagram of an exemplary control system 102 for controlling one or more operations of a marine vessel 100, according to various embodiments of the present disclosure. The marine vessel 100 may be embodied as any marine vessel, such as a ship, cruiser, or a boat. As illustrated, the marine vessel 100 may include a pair of engines 104, 106 that may be attached to a stern of a hull (not shown) for powering one or more components. In an exemplary embodiment, a first engine 104 may be attached to a rear port-side portion of the marine vessel 100, and thus will hereinafter be referred to as the port engine 104. A second engine 106 may be attached to a rear starboard-side portion of the marine vessel 100 and thus will hereinafter be referred to as the starboard engine 106. In some examples, the engines 104, 106 may be embodied as inboard engines positioned inside the vessel 100, while in some other examples, the engines 104, 106 may be embodied as outboard engines positioned outside the vessel 100. The port engine 104 and the starboard engine 106 may be configured to propel the marine vessel 100 via respective marine transmission systems, such as a port side transmission 108 and a starboard side transmission 110, respectively. It may be contemplated that the port engine 104, the port side transmission 108, the starboard engine 106 and the starboard side transmission 110 may all be configured to cooperate to propel the marine vessel 100 and/or serve as a backup in case one of the engines and/or transmissions fail.

Each of the port engine 104 and the starboard engine 106 may be based on one of the commonly applied power generation units, such as an internal combustion engine (ICE) having a V-type configuration, inline configuration, or an engine with different configurations, as are well known. The engines 104, 106 may embody any type of engine, such as a diesel engine, a gasoline engine, a gaseous fuel powered engine (e.g., a natural gas engine), or any other type of combustion engine apparent to one skilled in the art. Alternatively, the vessel 100 may include other types of power source, including a non-combustion source of power, such as a fuel cell, a power storage device, an electric motor, or other similar mechanism.

Each of the port side transmission 108 and the starboard side transmission 110 may be configured to transmit power from the respective port engine 104 and the starboard engine 106 to propellers, such as port side propellers 112 and starboard side propellers 114, respectively, to propel the vessel 100. For example, each of the transmissions 108, 110 may embody a multi-speed, bidirectional, mechanical transmission having a neutral gear ratio, a plurality of forward gear ratios, one or more reverse gear ratios, and one or more clutches (not shown). The transmissions 108, 110 may selectively actuate the clutches to engage predetermined combinations of gears (not shown) that produce a desired output gear ratio. The transmissions 108, 110 may be an automatic-type transmission, wherein shifting is based on a power source speed, and a maximum operator selected gear ratio. Alternatively, the transmissions 108, 110 may be manual transmissions, wherein the operator manually selects the gear that is engaged. Each of the port side transmission 108 and the starboard transmission 110 may be connected to the respective port engine 104 and starboard engine 106 by way of a torque converter (not shown). The output of each of the transmissions 108, 110 may be connected to rotatably drive the respective propellers 112, 114, thereby propelling the vessel 100.

The control system 102 further includes an engine control unit associated with each of the engines 104, 106. As illustrated, a first engine control unit 116 is associated with the port engine 104 while a second engine control unit 118 is associated with the starboard engine 106. Each of the engine control units 116, 118 are configured to control one or more operations of the respective engines 104, 106. For example, each of the first engine control unit 116 and the second engine control unit 118 may include one or more microprocessors, microcomputers, microcontrollers, programmable logic controller, DSPs (digital signal processors), central processing units, state machines, logic circuitry, or any other device or devices that process/manipulate information or signals based on operational or programming instructions. The engine control units 116, 118 may be implemented using one or more controller technologies, such as Application Specific Integrated. Circuit (ASIC), Reduced Instruction Set Computing (RISC) technology, Complex Instruction Set Computing (CISC) technology, etc.

Further, the control system 102 includes an operator console 120, positioned, fir example, on a deck 122 of the vessel 100. The operator console 120 may be embodied as a helm or dashboard, using which an operator may control the various operations of the vessel 100. As illustrated, the operator console 120 may include a first operating lever 124, a second operating lever 126 and an input/output unit 128 configured to facilitate operating the vessel 100, For example, the first operating lever 124 may be configured to control engine speed of the port engine 104 and transmission gear of the port side transmission 108. Similarly, the second operating lever 126 may be configured to control engine speed of the starboard engine 106 and the transmission gear of the starboard side transmission 110. In some embodiments, the first operating lever 124 and the second operating lever 126 may be configured to be in sync to control both the engines 104, 106 and the transmissions 108, 110 by using only one lever. Although the operator console 120 is illustrated and described to be having a lever based control, it may be contemplated that the operator console 120 may additionally or alternatively include other types of controls, such as steering controls, buttons and switches based controls, and so on, to control the operations of the vessel 100.

The input/output (I/O) unit 128 may be used to receive input from and/or provide system output to one or more devices or components and the operator of the vessel 100. System input may be received by the I/O unit 128 via, for example, a keyboard, keypad, a touch pad, potentiometers, switch inputs and/or a mouse while system output may be provided by the I/O unit 128 via, for example, a display unit 130, speakers, and/or other output devices, known in the art.

In an exemplary embodiment of the present disclosure, the control system 102 includes a first parity switch 132 and a second parity switch 134 for starting and stopping the port engine 104 and the starboard engine 106, respectively. Each of the first parity switch 132 and the second parity switch 134 may be embodied as a push start and stop parity switch which may be pushed to start and stop their respective engines 104, 106. Each of the first partly switch 132 and the second parity switch 134 is independently coupled to the operator console 120 to provide user inputs to the operator console 120 to control the respective one of the port engine 104 and the starboard engine 106. As illustrated, the parity switches 132 and 134 are positioned near the operator console 120, such as within the deck 122 of the vessel 100. In an exemplary embodiment of the present disclosure, the first parity switch 132 and the second parity switch 134 are independent of one another and are independently configured to initiate starting and stopping of their respective port engine 104 and the starboard engine 106 of the vessel 100.

In an embodiment of the present disclosure, each of the first parity switch 132 and the second parity switch 134 may be configured to be actuated for a first time and for a first time period T1 to receive a first user input to activate a remote start/stop control of the respective one of the port engine 104 and the starboard engine 106. In some examples, the first time period T1 may be within 0.1 seconds to 2 seconds, which means that when the parity switch 132 and/or 134, is actuated or pressed for the first time and remains pressed for any time duration between 0.1 seconds to 2 seconds, the remote start/stop control of the respective engine, via the operator console 120, is activated. In some alternative examples, the first actuation of the parity switches 132, 134 may be a simple press and release to activate the remote start/stop control of the respective engine 104, 106, via the operator console 120. An activation screen may be displayed, such as on the display unit 130 of the operator console 120 to indicate to the operator that the remote start/stop control of the respective one or both the port engine 104 and the starboard engine 106 is activated. In some exemplary implementations, the remote start/stop control and the activation screen may only be active for a predefined time duration P and the remote start/stop control of the engine(s) may be automatically deactivated after this predefined time duration has expired and if the operator has not pushed the respective parity switch for a second consecutive time. In an implementation, the predefined time duration P is 30 seconds, which means that once the first actuation of the parity switch 132, 134 is done, the remote start/stop control of the respective engine 104, 106 will remain active for 30 seconds and if the operator does not actuate the parity switch 132, 134 for the second time within 30 seconds, then the remote start/stop control may automatically be deactivated.

Further, each of the parity switches 132, 134 may be actuated for the consecutive second time and for a second time period T2, such as within the predefined time period P after the first actuation, to receive a second user input to switch the respective one of the engines 104, 106 to either an ON state (i.e., start the engine) or an OFF state (i.e., stop the engine). For instance, if the engine is running, then the second actuation indicates that the engine needs to switch to OFF state. Similarly, when the engine is stopped, then the second actuation indicates that the engine needs to switch to the ON state. In one embodiment, the second time period T2 may be less than or equal to a first predefined threshold TD1 to indicate a user input for initiating automatic cranking of the respective engines 104, 106.

In some implementations, the second time period T2 may be greater than the first predefined threshold TD1 and less than a second predefined threshold TD2 to indicate a user input for manual cranking of the respective engines 104, 106. In an exemplary embodiment, the first predefined threshold TD1 may be 2 seconds and the second predefined threshold TD2 may be 30 seconds. This means, when the parity switches 138, 140 are actuated for a second time period T2 that is less than or equal to 2 seconds, then the second actuation of the parity switch 138, 140 will initiate an automatic cranking of the respective engines 104, 106. Whereas, when the parity switches 138, 140 are actuated for the second time period 12 that is more than 2 seconds but less than or equal to 30 seconds, then a manual cranking of the respective engines 104, 106 is initiated. The manual cranking of the engines 104, 106 is continued as long as the respective parity switch 132, 134 is pressed or until the expiration of the second predefined threshold TD2, which is 30 seconds, in this case. In some embodiments, if the manual cranking does not result in engine starting, then the respective engine control units 116, 118 may send an error message to be displayed, such as on the display unit 130.

In some additional or alternate embodiments of the present disclosure, the second actuation of the respective parity switches 132, 134 for the second time period T2 that is less than or equal to a first predefined threshold TD1 (i.e. 2 seconds in this example) may be configured to initiate an auto pre-lube request for the respective engine control units 116, 118, and subsequently start the engines 104, 106 once the auto pre-lube is complete. Similarly, when the parity switches 138, 140 are actuated for a second time period T2 that is greater than the first predefined threshold TD1 (e.g., 2 seconds) and less than or equal to the second predefined threshold TD2 (e.g., 30 seconds), then the second actuation of the parity switch 138, 140 may initiate a manual pre-lube request and subsequently start the respective engines 104, 106 once the manual pre-lube is complete. For instance, the engine control units 116, 118 may perform an auto or manual pre-lubrication of the respective engines 104, 106 until oil pressure of the engines satisfies a predefined threshold, for example, reaches 15 kilo pascals. However, if there are any errors encountered by any of the engine control units 116, 118 in completing the pre-lube function, then an alert may be displayed, such as on the display device 130.

In an exemplary embodiment, the first parity switch 132 is electrically connected with the operator console 120 via a first normally open contact 129 and a first normally closed contact 131, and similarly, the second parity switch 134 is electrically connected with the operator console 120 via a second normally open contact 133 and a second normally closed contact 135. As will be understood, a normally open contact means the electrical connection between the parity switch and the operator console 120 is broken, that is when the parity switch is not pressed, it remains off and turns on when pressed. A normally closed contact means the electrical connection between the parity switch and the operator console 120 is closed meaning when the parity switch is not pressed, it remains on and turns off when pressed. Having both normally open and normally closed contacts between the parity switches 132, 134 and the operator console 120 provides safety and avoids unintentional switching ON of the engines 104, 106.

In an exemplary embodiment, when the first parity switch 132 is actuated for the second time indicating to start the port engine 104, then state of both the first normally open contact 129 and the first normally closed contact 131 is required to change to successfully request switching the port engine 104 to the ON state. Similarly, when the second parity switch 134 is actuated for the second time indicating to start the starboard engine 106, then state of both the second normally open contact 133 and the second normally closed contact 135 is required to change to successfully request switching the starboard engine 104 to the ON state. Therefore, if any one or more of the electrical contacts (i.e., one or more of the first normally open contact 129, the first normally closed contact 131, the second normally open contact 133 and the second normally closed contact 135) does not change or fails, then the corresponding parity switch 132, 134 fails and the second user input to start the respective engine 104, 106 is not initiated. In some embodiments, when any of the parity switches 132 and/or 134 encounters error in initiating the engine start request, then an error message may be displayed on the display unit 130 of the operator console 120 to alert the operator of the vessel 100.

Furthermore, when the first parity switch 132 is actuated for the second time to stop the port engine 104, then state of only one of the first normally open contact 129 and the first normally closed contact 131 is required to change to successfully request switching the port engine 104 to the OFF state. Similarly, when the second parity switch 134 is actuated for the second time to stop the starboard engine 106, then state of only one of the second normally open contact 133 and the second normally closed contact 135 is required to change to successfully request switching the starboard engine 106 to OFF state. Therefore, if none of the electrical contacts (i.e., one or more of the first normally open contact 129, the first normally closed contact 131, the second normally open contact 133 and the second normally closed contact 135) change their state in response to the second actuation of the respective parity switches, then the corresponding parity switch fails and the second user input to stop the respective engine is not initiated. In some embodiments, when any of the parity switches 132 and/or 134 encounters error in initiating the engine stop request, then an error message may be displayed on the display unit 130 of the operator console 120 to alert the operator of the vessel 100.

The control system 102 further includes a propulsion control unit 136 that may be configured to receive the one or more user inputs via the operator console 120 and control one or more components of the vessel 100 based on the received operator inputs. The propulsion control unit 136 may be positioned inside an engine room (not shown) of the vessel 100 and may be communicatively coupled to the operator console 120 via a network communication channel 138. In an embodiment of the present disclosure, the network communication channel 138 is an onboard Controller Area Network (CAN) bus that communicatively couples one or more components of the vessel 100. The operator console 120 may be configured to receive the first user input (corresponding to the first actuation of the parity switches 132, 134) and the second user input (corresponding to the second consecutive actuation of the parity switches 132, 134) and transmit these user inputs to the propulsion control unit 136 over the network communication channel 138.

Further, the propulsion control unit 132 may be configured to communicate with each of the first engine control unit 116 and the second engine control unit 118, such as over communication channels 140, 142, respectively, and transmit one or more engine operation signals based on the received one or more operator inputs. The engine control units 116, 118 may be configured to receive the one or more engine operating signals from the propulsion control unit 132 and accordingly control the one or more operations of the respective engines 104, 106. The propulsion control unit 132 may include one or more microprocessors, microcomputers, microcontrollers, programmable logic controller, DSPs (digital signal processors), central processing units, state machines, logic circuity, or any other device or devices that process/manipulate information or signals based on operational or programming instructions. The propulsion control unit 132 may be implemented using one or more controller technologies, such as Application Specific Integrated Circuit (ASIC), Reduced Instruction Set Computing (RISC) technology, Complex Instruction Set Computing (CISC) technology, etc.

The propulsion control unit 136 is configured to receive the user inputs from the first parity switch 132 and the second parity switch 134 via the operator console 120 and accordingly transmit one or more engine operating signals, in response to the received user inputs, to the corresponding first engine control unit 116 and the second engine control unit 118 based on one or more parameters associated with the respective engines 104, 106. To this end, the propulsion control unit 136 may be configured to receive one or more engine parameters associated with each of the port engine 104 and the starboard engine 106 from the respective first engine control unit 116 and the second engine control unit 118. For instance, the propulsion control unit 136 may receive feedbacks from the respective engine control units 116, 118 on whether the requested user input can be successfully executed based on the current operational parameters of the associated engines 104, 106. The operational parameters associated with the engines 104, 106 may include, but not limited to, the engine speed, an engine operating state, engine consent, and so on. To this end, as shown, the port engine 104 may include a first engine speed sensor 144 configured to monitor the engine speed of the port engine 104 and transmit the same to the propulsion control unit 136 via the first engine control unit 116. Similarly, the starboard engine 106 includes a second engine speed sensor 146 configured to monitor the engine speed of the starboard engine 106 and transmit the same to the propulsion control unit 136 via the second engine control unit 118. The propulsion control unit 136 may be configured to transmit the engine operating signals to the respective engines 104, 106 based on the received engine speed. For instance, if the engine speed is detected to be zero, then the propulsion unit 136 may transmit the signal to start the engine in response to the received second user input (i.e., on the second actuation of the respective parity switch 132, 134), whereas, when the engine speed is detected to be above a threshold, such as over 400 rpm, then the propulsion control unit 136 may detect that the engine is already running, and thus transmit the signal to stop the engine in response to the received second user input (i.e., the second actuation of the respective parity switch 132, 134).

Further, the propulsion control unit 136 may also receive one or more transmission parameters associated with the transmissions 108, 110 from the respective engine control units 116, 118 and accordingly transmit the engine operating signals based also on the received transmission parameters. The transmission parameters may include, but not limited to, the current selected transmission gear for each of the respective transmissions 108, 110. The engine control units 116, 118 may be configured to receive the engine operating signals from the propulsion control unit 136 and operate the respective engines 104, 106 in accordance with the received signals.

Figure 2:
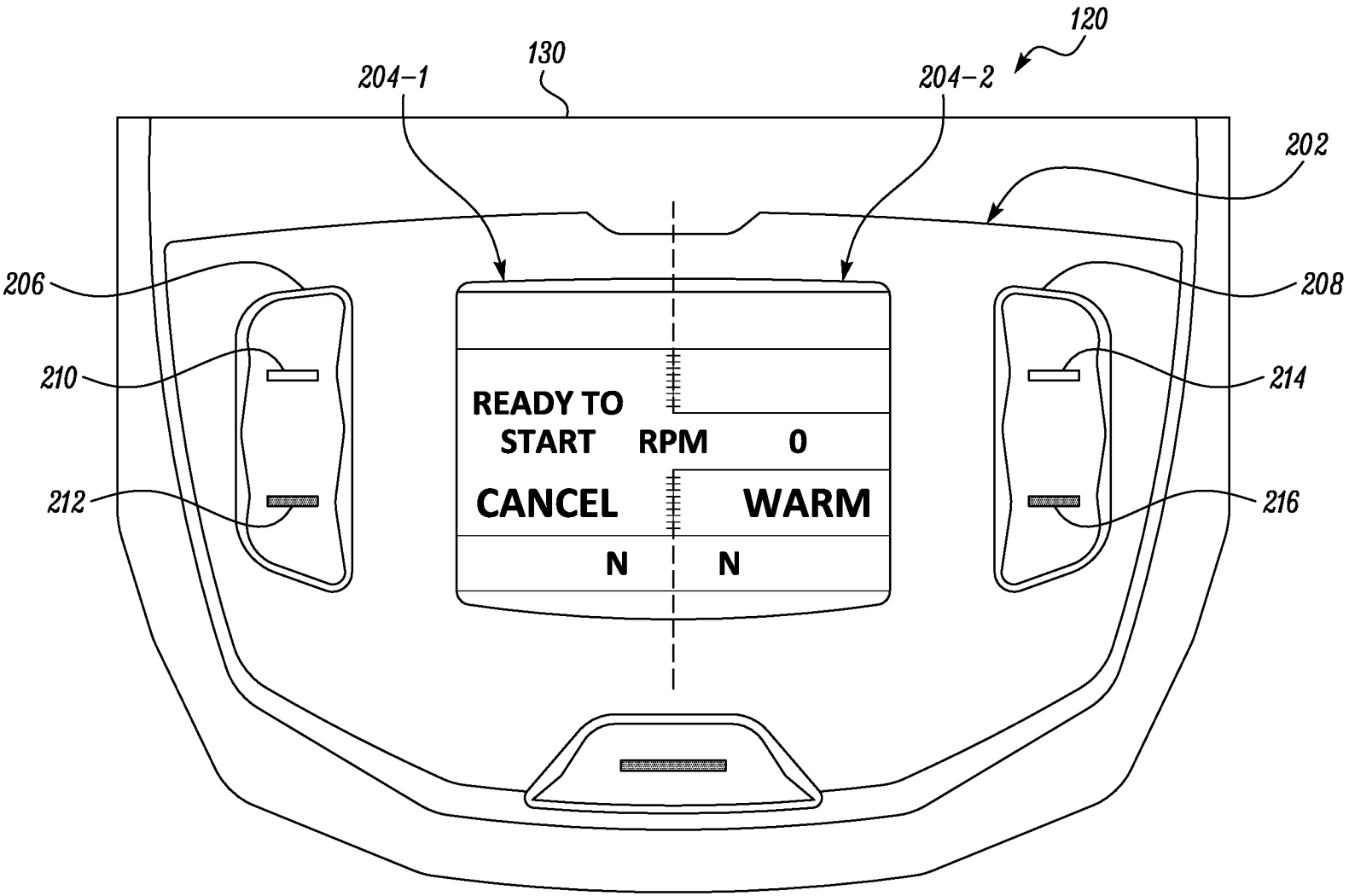
FIGS. 2 through 9 illustrates exemplary user interfaces displayed on an operator console, in accordance with the embodiments of the present disclosure.

In an exemplary embodiment, the propulsion control unit 136 is configured to receive feedback from each of the engine control units 116, 118 in response to even user input and corresponding engine operating signal and transmit the one or more feedback signals to the operator console 120 to be displayed on the display unit 130. Further, the operator console 120 may be configured to receive the one or more operational parameters, such as the engine speed, and the engine operating status associated with each of the port engine 104 and the starboard engine 106 from the respective engine control units 116, 118 via the propulsion control unit 136 and display the same on the display unit 130. Similarly, the operator console 120 may be configured to receive the one or more transmission parameters from the engine control units 116, 118 via the propulsion control unit 136 and display the same on the display unit 130. Furthermore, the operator console 120 may be configured to display alerts on the display device 130 in response to the received user inputs, the engine operational parameters and/or one or more transmission parameters when the propulsion control unit 136 sends a feedback signal indicative of an error in transmitting the one or more engine operating signals to one or more of the respective first engine control units 116 and the second engine control unit 118, FIG. 2 illustrates an exemplary user interface 202 displayed on the display unit 130 of the operator console 120. As explained previously, when the parity switches 132, 134 are actuated for the first time, the remote start/stop control of the respective engines 104, 106 is activated and an activation screen is displayed on the display unit 130. In an exemplary embodiment, the user interface 202 may be divided into sections, such as a first interface section 204-1 corresponding to the port engine 104 and a second interface section 204-2 corresponding to the starboard engine 106. Although, only two interface sections are illustrated and described, it may be contemplated that the user interface 202 may be divided into any number of sections, such as when the vessel includes more numbers of engines, to achieve similar results without deviating from the scope of the claimed subject matter.

As shown, the user interface 202 includes a first set of user operable input buttons 206 corresponding to the operations of the port engine 104 and a second set of user operable input buttons 208 corresponding to the operations of the starboard engine 106. The first set of user operable input buttons 206 includes a first button 210, and a second button 212 that may be actuated by the operator to select a corresponding input option displayed on the first interface section 204-1 for operating the port engine 104, Similarly, the second set of user operable input buttons 208 includes a third button 214 and a fourth button 216 that may be actuated by the operator to select a corresponding input option displayed on the second interface section 204-2 for operating the starboard engine 106, In an exemplary implementation, the user operable input buttons 210, 212, 214 and 216 may be selectively activated based on the one or more input options available to the operator during operation and as displayed in the corresponding interface sections 204-1, 204-2, It may be contemplated that the operator console 120 may also include additional controls that have not been described here for the sake of simplicity of the present disclosure.

In operation, for example, when the first parity switch 132 is actuated, the first user input is sent to the propulsion control unit 136 by the operator console 120. The propulsion control unit 136, then communicates with the first engine control unit 116 to detect the current engine speed, the current transmission gear, and the engine consent associated with the port engine 104. In some embodiments, the port engine 104 may include its own local operating panel which evaluates running conditions of the port engine 104 and detects if there is any fault that prevents the port engine 104 from starting. Thus, if the local operating panel does not detect any fault or reason that prevents the port engine from starting, then it gives the engine starting consent as 'yes' to the propulsion control unit 136. However, if the local operating panel detects any fault or reason that prevents the port engine 104 from starting, then it provides the engine consent as 'no' to the propulsion control unit 136. In an exemplary embodiments, if the propulsion control unit 136 detects that the engine speed is zero (indicating that the engine is stopped or not running), the transmission gear is in neutral and the engine consent is 'yes', then the propulsion control unit 136 determines that the port engine 104 is ready to start and accordingly transmits this feedback to the operator console 120, which then displays a message "Ready to Start" on the first interface section 204-1 of the user interface 202, as shown in FIG. 2. As also shown, if the operator changes their mind and does not wish to proceed to start the port engine 104, then he may actuate the "Cancel" option displayed on the first interface section 204-1 by actuating the activated button 212. Thus, the remote start/stop control of the port engine 104 is deactivated.

Figure 3:
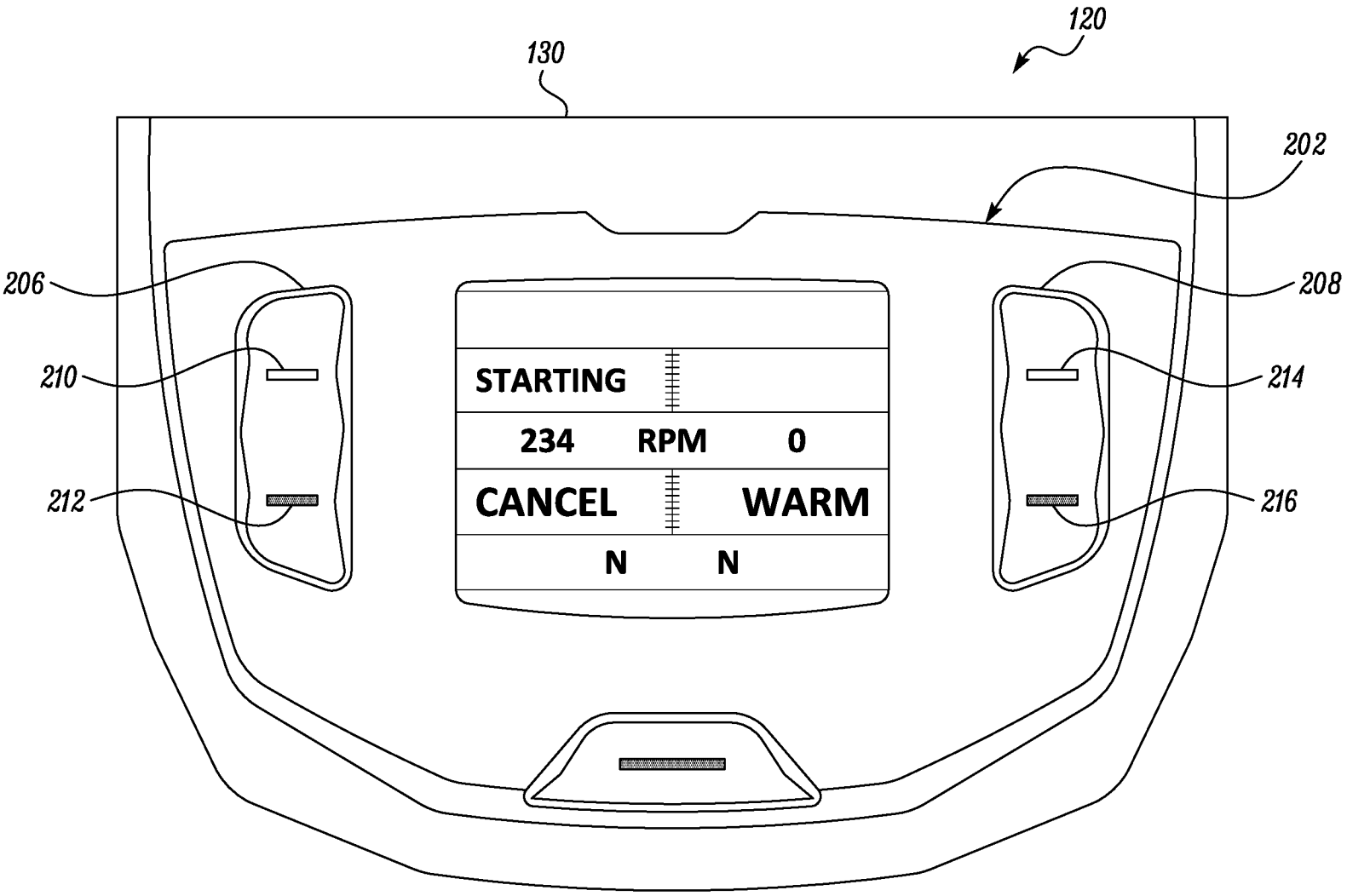

Further, the operator may actuate the first parity switch 132 the second time to start the port engine 104, if both the normally open contact 129 as well as the normally closed contact 131 change upon actuation of the first parity switch 132, then the user input is transmitted to the propulsion control unit 136 by the operator console 120 and the propulsion control unit 136 then transmits the engine operating signal to the first engine control unit 116 to start the port engine 104, If the first engine control unit 116 does not encounter error, then it will start the port engine 104 and start transmitting the engine speed and the engine operating state of the port engine 104 to the propulsion control unit 136. The propulsion control unit 136 is further configured to transmit this information to the operator console 120. Thus, the operator console 120 is configured to update the first interface section 204-1 to display the status of the port engine and the engine speed in RPM. For example, as shown in FIG. 3, when the port engine 104 starts, the engine operating state is displayed as "Starting" and the engine RPM starts to increase, as displayed on the first interface section 204-1.

Figure 4:
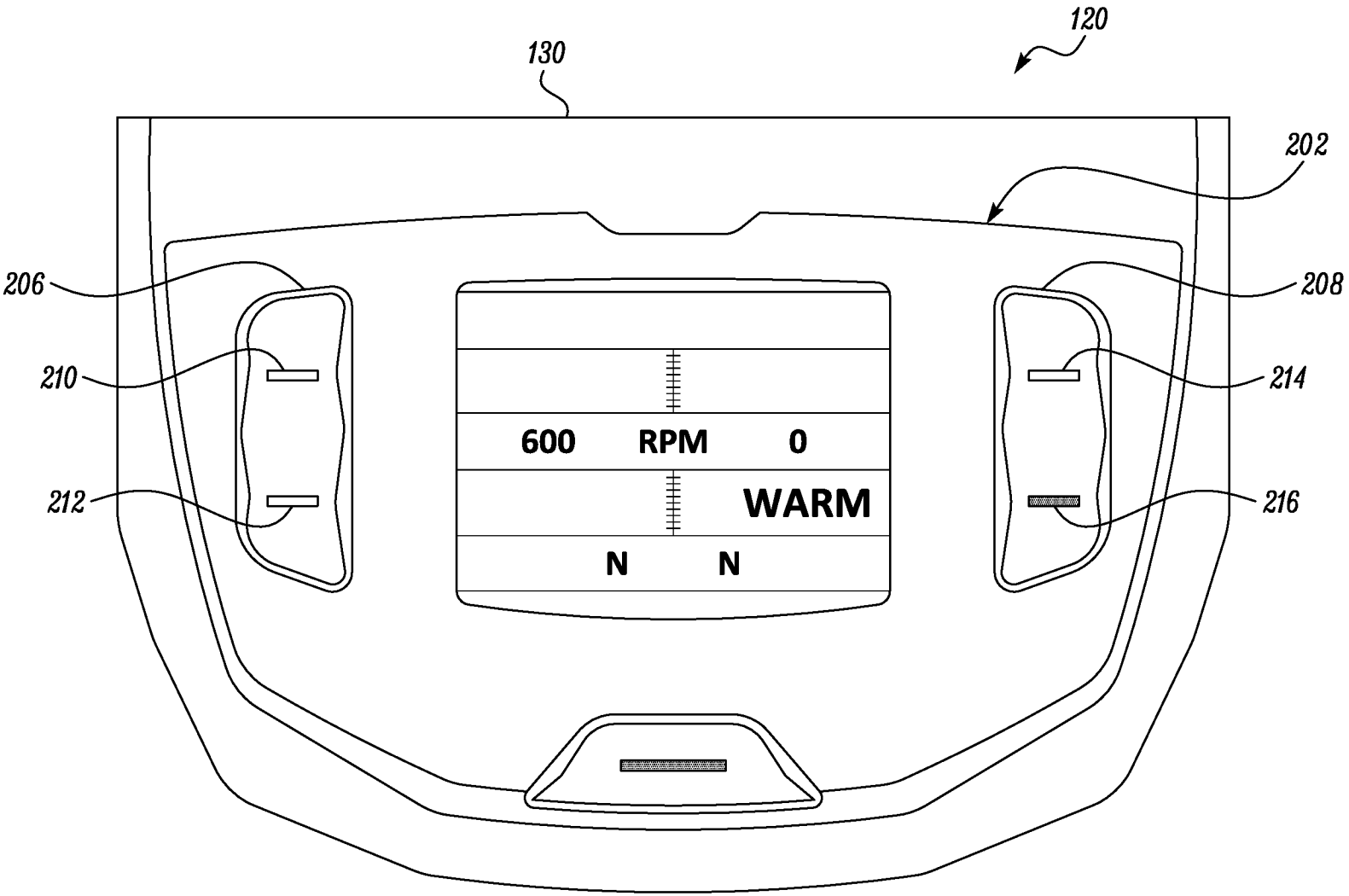
Figure 5:
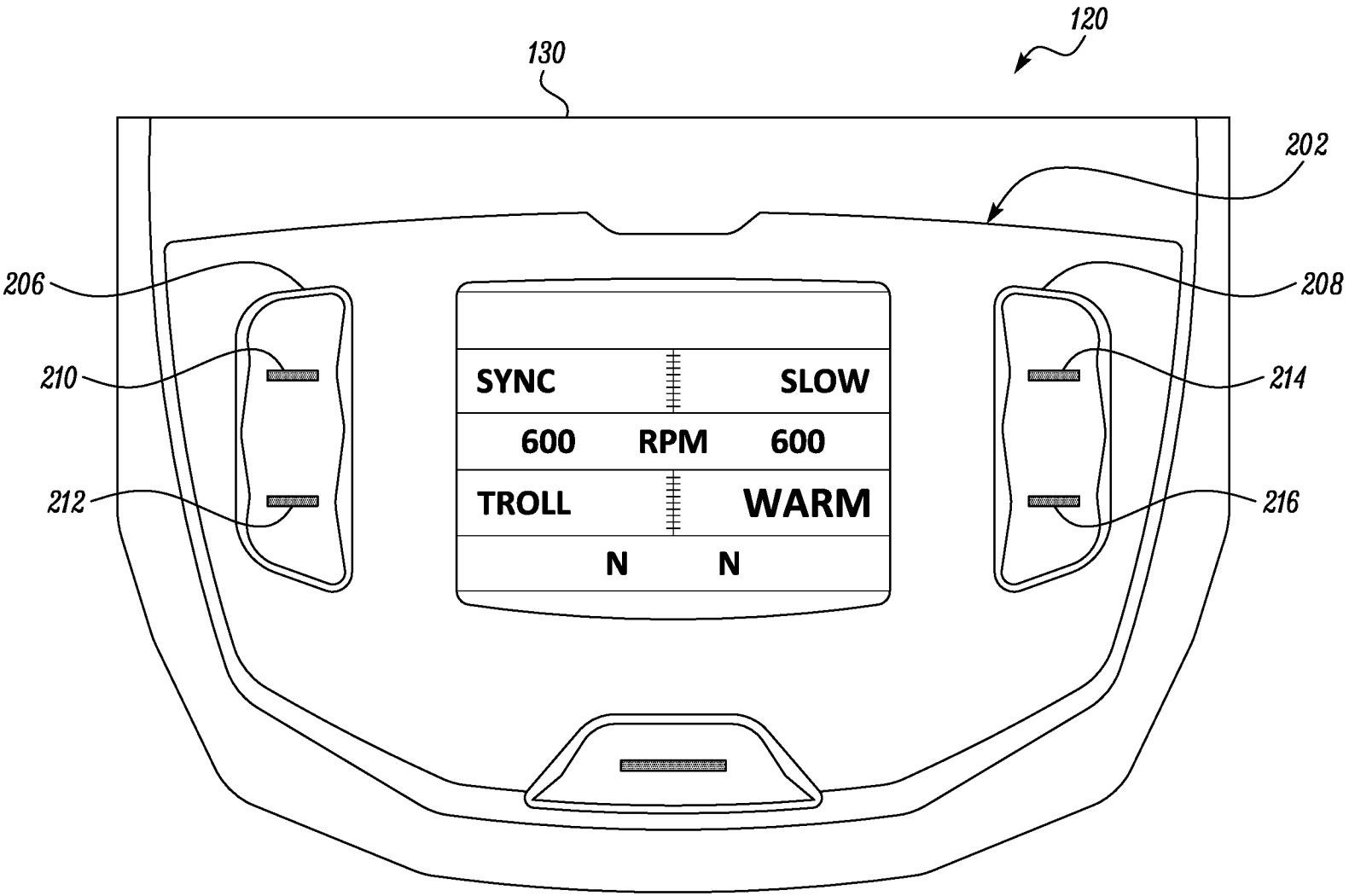

Furthermore, when the first engine control unit 116 detects that the engine RPM has reached a threshold, such as up to an engine idle running speed (i.e., 600 RPM in this example), then it updates the engine operating state from "starting" to "running" and transmits the updated engine operating state and the engine speed to the propulsion control unit 136. The propulsion control unit 136 is then configured to transmit this feedback information to the operator console 120, which then updates the first interface section 204-1 to display this updated information. Thus, the first interface section 204-1 may display the updated engine running speed (as shown in FIG. 4) and thereafter deactivate the remote start/stop control of the respective engine, i.e., the port engine 104, via the operator console 120. In some implementations, once the port engine 104 is up and running, the first interface section 204-1 of the user interface 202 may continue to display other operation control options, such as throttle controls, gear controls, etc., for operating the port engine 104.

The second parity switch 134 may also be actuated in a similar manner to start the starboard engine 106, either along with starting the port engine 104 or after the port engine 104 has started. As shown for the port engine 104 in FIGS. 2 through 4, the second interface section 204-2 is also updated in response to the first and second actuation of the second parity switch 132. Thus, when the second parity switch 134 is actuated for the first time, the second interlace section 204-2 may display the message "Reads to Start" and after the second actuation, may first display "Starting" followed by the detected engine speed, in a similar manner as described above. Once the starboard engine 106 is up and running, the remote start/stop control of it is deactivated and the second interface section 204-2 of the user interface 202 may continue to display other operation control options, such as throttle controls, gear controls, etc., for operating the starboard engine 104.

Further, in an exemplary implementation, when both the engines 104, 106 are up and running, the user interface 202 may display additional operations that the operator can perform for propelling the vessel 100. For example, the user interface 202 may display an activated "Sync" mode to facilitate operating both the port engine 104 and the starboard engine 106 using a single lever in the operating console 120. Along with the "Sync" mode, the button 210 is also activated to allow receiving user input to activate the "Sync" mode. Further, the user interface 202 may also display an activated "Slow" mode to facilitate altering of low idle speed of the port engine 104 and the starboard engine 106. For example, when the "Slow" mode is activated, the propulsion unit 136 may adjust the low idle engine speed to 550 rpm and accordingly operate both the port engine 104 and the starboard engine 106 at the reduced speed. Along with the "Slow" mode, the button 214 is also activated to allow receiving user input to activate the "Slow" mode.

Furthermore, the user interface 202 may display an activated "Troll" mode to facilitate intentional clutch slipping during operation of the vessel 100. For example, when the "Troll" mode is activated, one or more troll valves (not shown) may be activated to release pressure on the clutch packs in the transmissions 108, 110 to create clutch slipping and control the speed of the propellers 112, 114 with respect to the engine speed of the respective port engine 104 and the starboard engine 106. Similar to the "Sync" and the "Slow" mode, along with the "Troll" mode, the button 212 is also activated to allow receiving user input to activate the "Troll" mode. Additionally, the user interface 202 max also display an activated "Warm" mode to facilitate warming up of the engines 104, 106. Along with the "Warm" mode, the button 216 is also activated to allow receiving user input to activate the "Warm" mode. It may be contemplated that these additional operations are merely exemplary and other additional operations may also be activated and displayed on the user interface 202 in a similar manner, without deviating from the scope of the claimed subject matter.

In a further embodiment of the present disclosure, stopping of the engines 104, 106 may also be performed in a similar manner, as described above for starting the engines 104, 106. For example, while the engines 104, 106 are running, and the operator actuates the parity switches 132, 134 for the first time, then the remote start/stop control for the engines 104, 106 may be activated. Further, when the operator actuates the respective parity switch 132, 134 for a second time, then the propulsion control unit 136 may be configured to receive this second user input and receive the engine operating parameters, engine operating state, engine consent and transmission parameters in a similar manner as described above.

Figure 6:
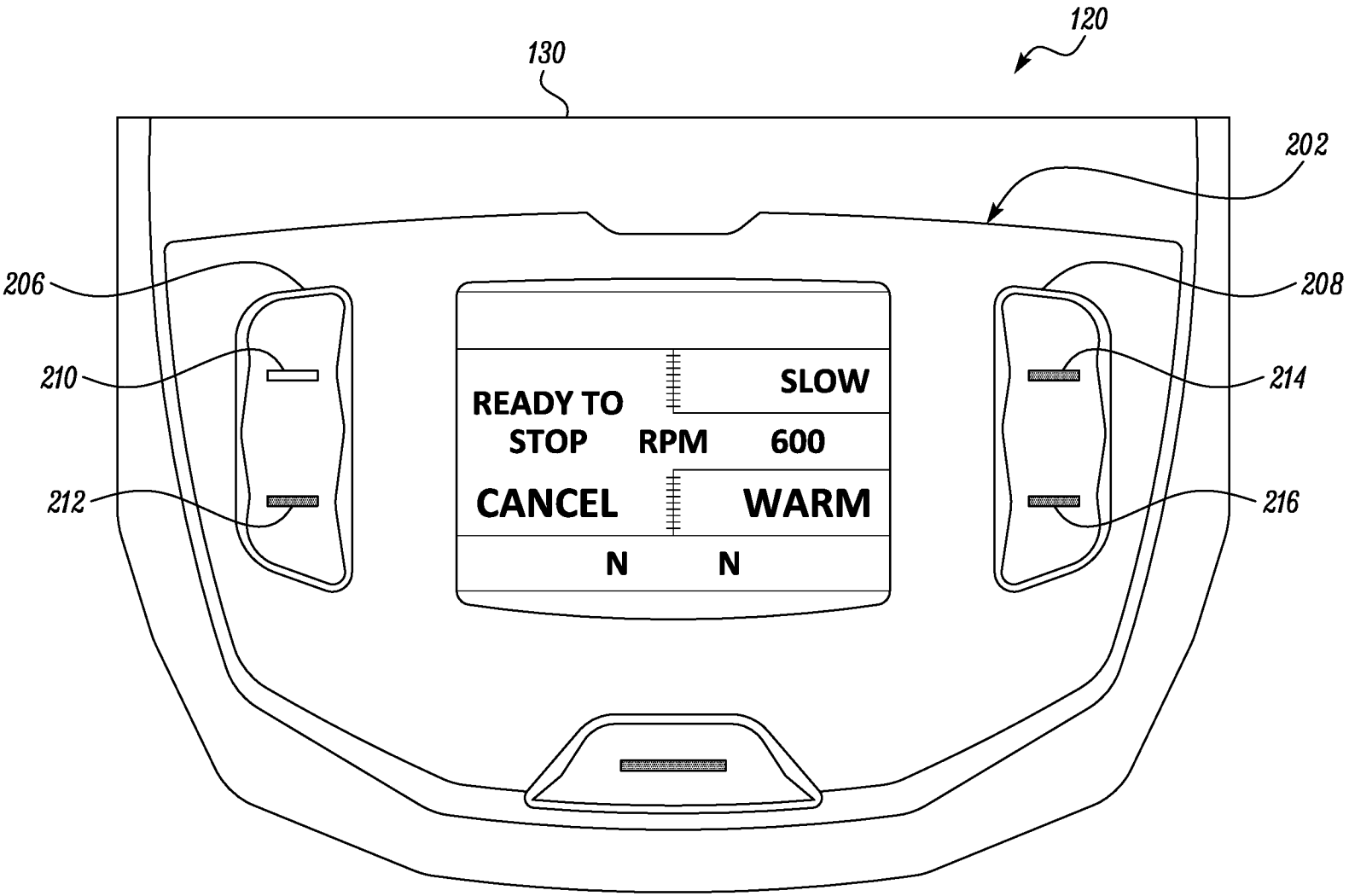

For example, as shown in FIG. 6, when the operator actuates the first parity switch 132 for the first time while the engines 104, 106 are running, the user interface 202 will be updated to display the message "Ready to stop" in the first interface section 204-1 of the port engine 104. Similar to the starting operation, the propulsion control unit 136, may communicate with the first engine control unit 116 to detect the current engine speed, the current transmission gear, and the engine consent associated with the port engine 104. If the propulsion control unit 136 detects that the engine speed and its operating state indicates that the engine is running, and the engine consent is 'yes', then the propulsion control unit 136 determines that the port engine 104 is ready to stop and accordingly transmits this feedback to the operator console 120, which then displays a message "Ready to Stop" on the first interface section 204-1 of the user interface 202.

Figure 7:
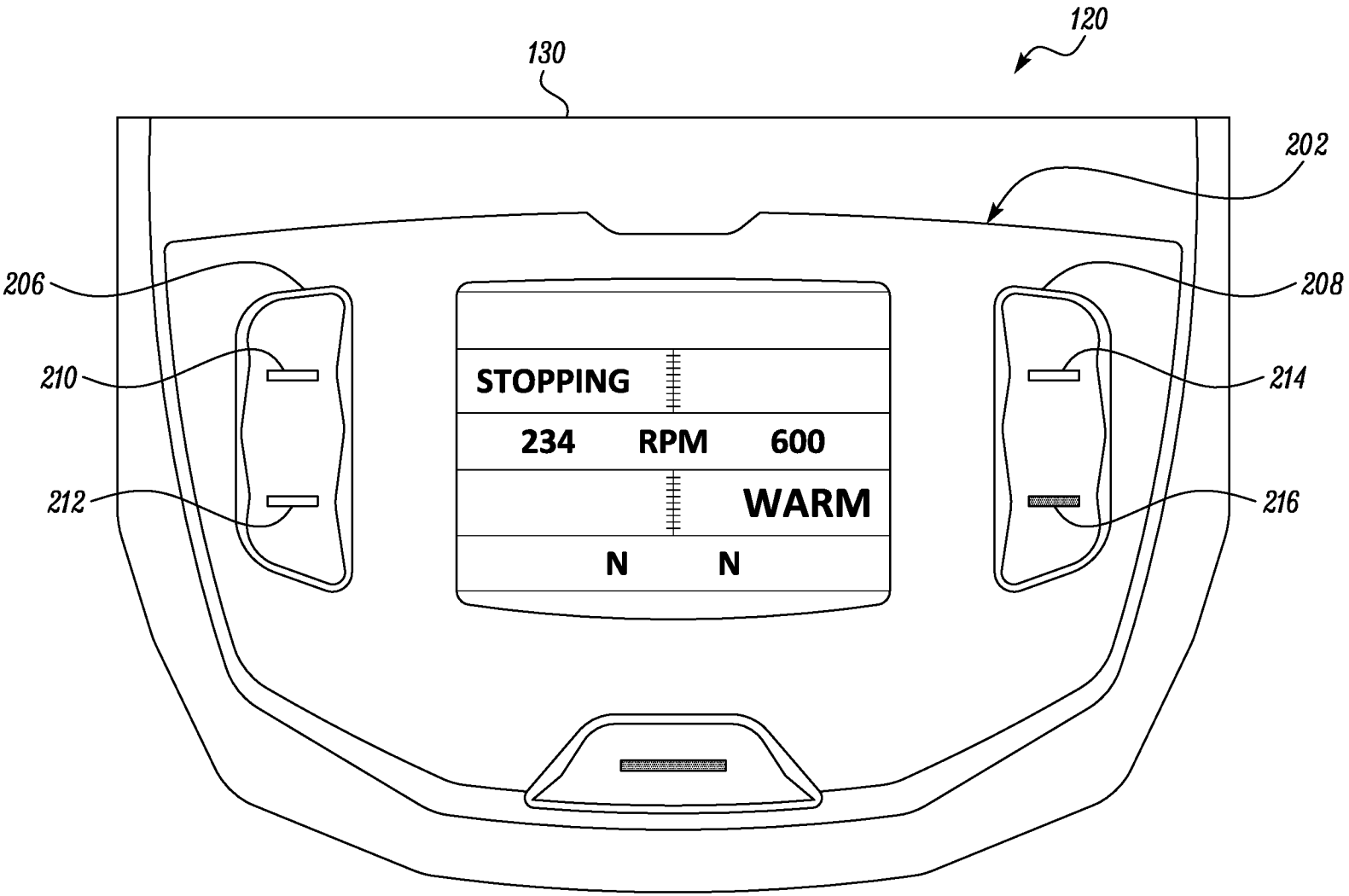

Further, the operator may actuate the first parity switch 132 for the second time to stop the port engine 104. If one of the normally open contact 129 and/or the normally closed contact 131 changes upon actuation of the first parity switch 132, then the user input is transmitted to the propulsion control unit 136 by the operator console 120 and the propulsion control unit 136 then transmits the engine operating signal to the first engine control unit 116 to stop the port engine 104. If the first engine control unit 116 does not encounter error, then it will stop the port engine 104 and continue transmitting the decreasing engine speed and the engine operating state of the port engine 104 to the propulsion control unit 136. The propulsion control unit 136 is further configured to transmit this information to the operator console 120. Thus, the operator console 120 is configured to update the user interface 202 to display the status of the port engine and the engine speed in RPM. For example, as shown in FIG. 7, when the port engine 104 is stopping, the engine operating state is displayed as "Stopping" and the engine RPM starts to decrease, as displayed on the user interface 202 of the display unit 130. Once the engine 104 is completely stopped, the remote start/stop control of the port engine 104 may be deactivated.

Furthermore, the second parity switch 134 may also be operated in a similar manner to stop the starboard engine 106 and the user interface 202 may also be updated for the various stopping stages of the starboard engine 106 in a similar manner, as described above for the port engine 104. It may be further contemplated that the operating states as "Ready to Start", "Starting", "Running", and "Ready to stop" are only exemplary and in practical applications, other operating states may also be determined and displayed on the user interface 202 in a similar manner without deviating from the scope of the claimed subject matter.

Figure 8:
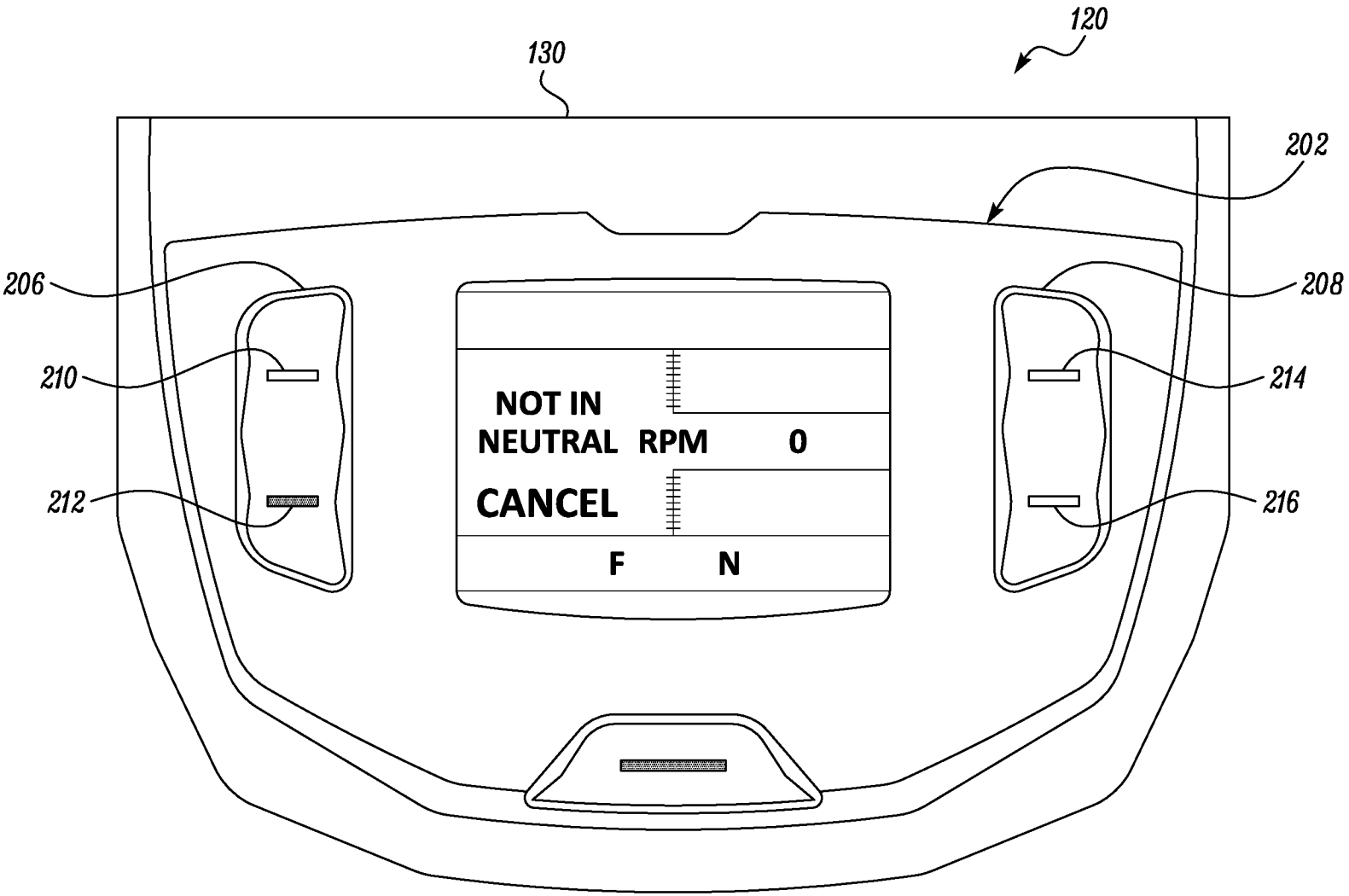
Figure 9:
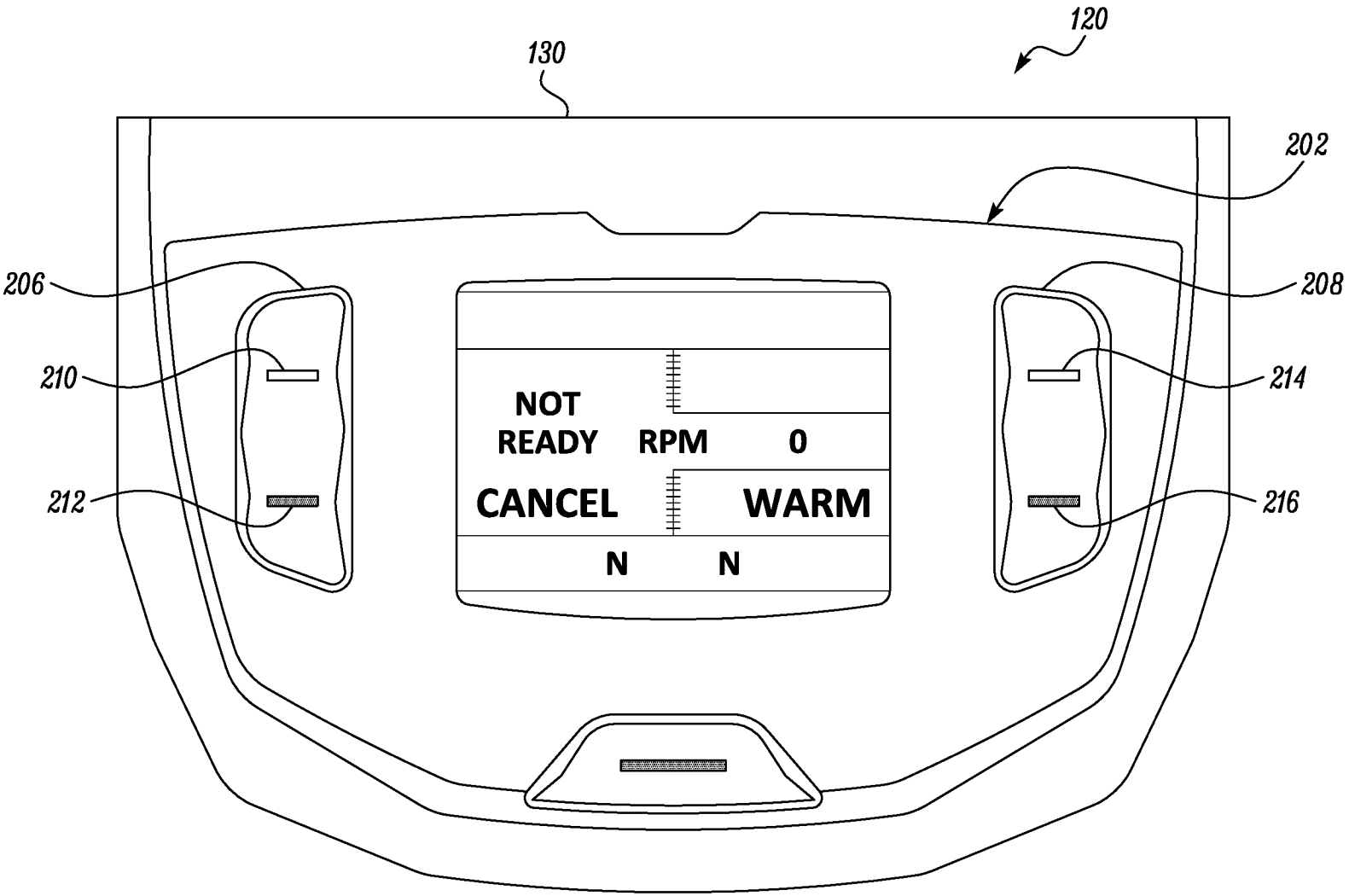

Further, the propulsion control unit 136 may be configured to provide feedback to the operator console 120 if any error is detected in either starting or stopping the engines 104, 106. Such feedback may be received by the operator console 120 and displayed on the user interface 202 of the display unit 130. For example, if while requesting engine start, such as that of the port engine 104, the propulsion unit 136 detects that the transmission gear is not in Neutral, then the engine start request will not be processed and an error message, such as "Not in Neutral" may be displayed on the user interface 202, as shown in FIG. 8. Similarly, if the propulsion control unit receives a "No" consent from the local operating panel associated with the engines, such as the port engine 104, then the propulsion control unit 136 may be configured to provide the error to the operator console 120 and an alert message "Not Ready" may be displayed on the user interface 202 of the display unit 130, as shown in FIG. 9.

Additionally, any other errors, as detected by the propulsion control unit 136 may be displayed as alerts on the user interface 202. For instance, if the engine 104, 106 has just stopped and is in a "cool down" state, then immediate request to start the same engine may be prohibited by the propulsion control unit 136. Accordingly, the error message "Cool Down" may be displayed on the user interface 202 for the corresponding engine 104, 106. In some implementations, the cool down time remaining may also be displayed along with the error message. It will be appreciated by a person skilled in the art that these error messages are exemplary and in practicality, other error messages corresponding to other conditions may also be displayed without deviating from the scope of the claimed subject matter.

Further, as explained previously, both the port engine 104 and the starboard engine 106 and their respective parity switches 132, 134 are configured to be independent of one another. Thus, as and when these parity switches 132, 134 are actuated, the propulsion control unit 136 may be configured to independently execute the engine start and stop requests according to the individual operating parameters, transmission parameters, and the respective engine consent for the respective engines 104, 106. Further, although only one deck 122 having one operator console 120 and one pair of parity switches 132, 134 is illustrated and described herein, it may be contemplated that for large vessels 100, multiple decks may include their respective operator consoles and parity switches that function in the same manner to facilitate remote controlling of the port engine 104 and the starboard engine 106 from multiple locations on the vessel 100.

INDUSTRIAL APPLICABILITY

Figure 10:
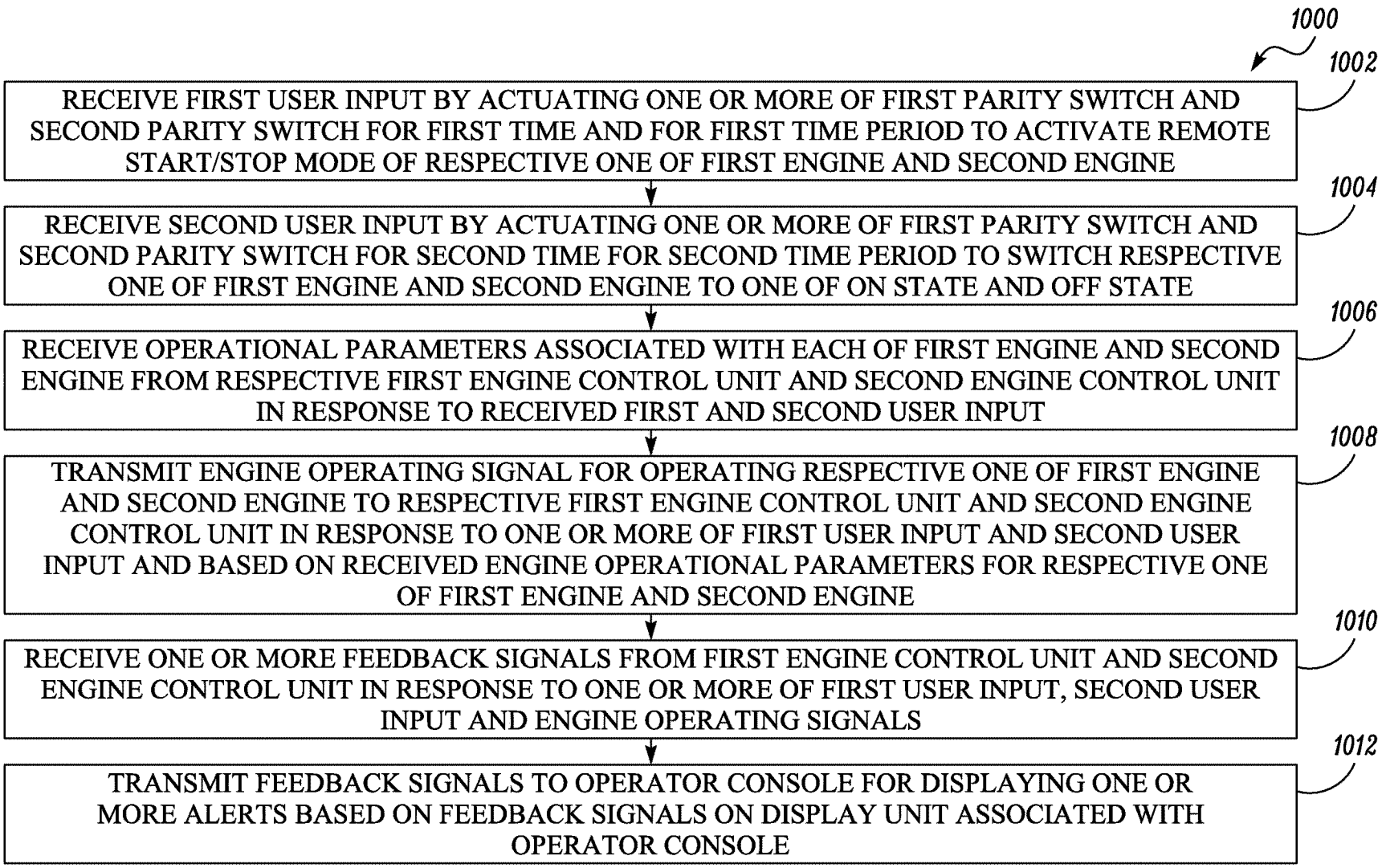
FIG. 10 illustrates an exemplary method flowchart for controlling operations of the marine vessel, in accordance with the embodiments of the present disclosure.

FIG. 10 illustrates an exemplary method 1000 for controlling the operations of the first engine, i.e., the port engine 104 and the second engine, i.e., the starboard engine 106 of the marine vessel 100. At step 1002, a first user input is received by actuating one or more of the first parity switch 132 and the second parity switch 134 for the first time and for a first time period to activate the remote start/stop control of respective one of the port engine 104 and the starboard engine 106. In an embodiment, the propulsion control unit 136 is configured to receive the first user input from the operator console 120 over the network communication channel 138. For example, the first time period T1 may be within 0.1 seconds to 2 seconds, which means that when the parity switch 132 and/or 134, is actuated or pressed for the first time and remains pressed for any time duration between 0.1 seconds to 2 seconds, the remote start/stop control of the respective engine is activated. In some alternative examples, the first actuation of the parity switches 132, 134 may be a simple press and release to activate the remote start/stop control of the respective engine 104, 106. An activation screen may be displayed, such as on the display unit 130 of the operator console 120 to indicate to the operator that the remote start/stop control of the respective one or both the port engine 104 and the starboard engine 106 is activated.

At step 1004, a second user input is received by actuating one or more of the first parity switch 132 and the second parity switch 134 for the second time and for a second time period to switch the respective one of the port engine 104 and the starboard engine 106 to one of an ON state or an OFF state. For instance, if the engine is running, then the second actuation indicates that the engine needs to switch to OFF state. Similarly, when the engine is stopped, then the second actuation indicates that the engine needs to switch to the ON state. For example, the propulsion control unit 136 is configured to receive the second user input from the operator console 120 over the network communication channel 138. In one embodiment, the second time period T2 may be less than or equal to a first predefined threshold TD1 (such as 2 seconds) to indicate a user input for initiating automatic cranking of the respective engines 104, 106, In some embodiments, the second time period T2 may be greater than the first predefined threshold TD1 (such as 2 seconds) and less than a second predefined threshold TD2 (such as 30 seconds) to indicate a user input for manual cranking of the respective engines 104, 106.

Further, at step 1006, operational parameters associated with each of first engine and second engine are received from the respective first engine control unit 116 and the second engine control unit 118 in response to the received first and second user input. Further, at step 1008, one or more engine operating signal are transmitted for operating respective one of the port engine 104 and the starboard engine 106, by the propulsion control unit 136 to respective first engine control unit 116 and the second engine control unit 118 in response to one or more of the first user input and the second user input and based on the received engine operational parameters for respective one of port engine 104 and the starboard engine 106.

For instance, the propulsion control unit 136 may receive feedbacks from the respective engine control units 116, 118 on whether the requested user first and/or second user input can be successfully executed based on the current operational parameters of the associated engines 104, 106 and the transmission parameters associated with the respective transmissions 108, 110. The operational parameters associated with the engines 104, 106 may include, but not limited to, the engine speed, an engine operating state, engine consent, and so on. For instance, if the engine speed is detected to be zero, then the propulsion unit 136 may transmit the signal to start the engine in response to the received second user input (i.e., on the second actuation of the respective parity switch 132, 134), whereas, when the engine speed is detected to be above a threshold, such as over 400 rpm, then the propulsion control unit 136 may detect that the engine is already, running, and thus transmit the signal to stop the engine in response to the received second user input (i.e., the second actuation of the respective parity switch 132, 134).

Further, the propulsion control unit 136 may also use one or more transmission parameters to transmit the engine operating signals. For example, the transmission parameters may include, hut not limited to, the current selected transmission gear for each of the respective transmissions 108, 110. For example, if the propulsion control unit 136 detects that the transmission gear is in neutral, then the propulsion control unit 136 may successfully transmit the signal to start the respective engine 104, 106. However, if the transmission gear is not in neutral, the propulsion control unit 130 may prohibit starting of the engines 104, 106.

Furthermore, at step 1010 one or more feedback signals are received by the propulsion control unit 136 from the respective first engine control unit 116 and the second engine control unit 118 in response to the one or more of the first user input, second user input and the engine operating signals. At step 1012, these feedback signals are transmitted by the propulsion control unit 136 to the operator console 120 over the network communication channel 138 for displaying one or more alerts based on the feedback signals on the display unit 130 associated with the operator console 120. For example, the operator console 120 may be configured to receive the one or more operational parameters, such as the engine speed, and the engine operating status associated with each of the port engine 104 and the starboard engine 106 from the respective engine control units 116, 118 via the propulsion control unit 136 and display the same on the display unit 130. Similarly, the operator console 120 may be configured to receive the one or more transmission parameters from the engine control units 116, 118 via the propulsion control unit 136 and display the same on the display unit 130. Furthermore, the operator console 120 may be configured to display alerts on the display device 130 in response to the received user inputs, the engine operational parameters and/or one or more transmission parameters when the propulsion control unit 136 sends a feedback signal indicative of an error in transmitting the one or more engine operating signals to one or more of the respective first engine control units 116 and the second engine control unit 118.

The control system 102 and method 1000 of the present disclosure provide an easy and efficient integration of remote push start and stop functionality for controlling the operations of the port engine 104 and starboard engine 106. The control system 102 eliminates the requirement of third party system integrations and facilitates easy implementation of such remote start/stop functionality irrespective of the size of the marine vessel 100. Generally, for larger vessels, the engine room may be at a distance from the deck 122 and an operator may or may not be able to view and/or hear what is happening within the engine room from the deck 122. Therefore, in conventional systems, implementing remote start/stop control for operating engines was either not feasible or required heavy wiring. The control system 102 of the present disclosure, not only makes it possible to implement the remote start/stop functionalities for the engines 104, 106 but also eliminates the requirement of heavy and complex wiring by implementing the communication between the operator console 120 (positioned within the deck 122) and the propulsion control unit 136 (positioned within the engine room) over a network communication channel 138, such as the onboard CAN bus. Therefore, the control system 102 provides for an efficient and cost effective solution for implementing remote start/stop functionalities for controlling the port engine 104 and the starboard engine 106.

It will be apparent to those skilled in the art that various modifications and variations can be made to the system of the present disclosure without departing from the scope of the disclosure, Other embodiments will be apparent to those skilled in the art from consideration of the specification and practice of the system disclosed herein. It is intended that the specification and examples be considered as exemplary only, with a true scope of the disclosure being indicated by the following claims and their equivalent.

What is claimed is:

1. A control system for controlling operations of a marine vessel having a first engine and a second engine operable to propel the marine vessel, the control system comprising:

a first parity switch being operable to start and stop the first engine and a second parity switch being operable to start and stop the second engine; wherein each of the first parity switch and the second parity switch being configured to be:

actuated for a first time for a first time period to receive a first user input to activate a remote start/stop control of the respective one of the first engine and the second engine; and actuated for a second consecutive time for a second time period to receive a second user input to switch the respective one of the first engine and the second engine to one of an ON state and an OFF state;

an operator console positioned in a deck of the marine vessel, the operator console being communicatively coupled to each of the first parity switch and the second parity switch to receive one or more of the first user input and the second user input from the respective first parity switch and the second parity switch; and a propulsion control unit communicably coupled to the operator console via a network communication channel, a first engine control unit associated with the first engine and a second engine control unit associated with the second engine, the propulsion control unit being configured to:

receive one or more of operational parameters associated with each of the first engine and the second engine from the respective first engine control unit and the second engine control unit;

receive the second user input from each of the first parity switch and the second parity switch via the operator console; and transmit one or more engine operating signal for operating each of the first engine and the second engine to the respective first engine control unit and the second engine control unit, the one or more engine operating signal being in response to the second user input and the received one or more engine operational parameters.

2. The control system of claim 1, wherein each of the first parity switch and the second parity switch is electrically connected to the operator console via a respective normally open contact and a normally closed contact.

3. The control system of claim 2, wherein each of the respective normally open contact and a normally closed contact is configured to change state when the respective one of first parity switch and second parity switch is actuated to initiate a start request for respective one of the first engine and the second engine.

4. The control system of claim 2, wherein one of the respective normally open contact and a normally closed contact is configured to change state when the respective one of first parity switch and second parity switch is actuated to initiate a stop request for respective one of the first engine and the second engine.

5. The control system of claim 1, wherein the one or more engine operational parameters include an engine speed and engine operating state.

6. The control system of claim 1, wherein the propulsion control unit is further configured to:

receive one or more transmission parameters associated with one or more of a first transmission connected with the first engine and a second transmission connected with the second engine; and transmit one or more operating engine operating signal based on the received one or more transmission parameters associated with the respective one of the first transmission and the second transmission.

7. The control system of claim 1, wherein the propulsion control unit is configured to transmit an engine operating signal in response to the second user input to switch the respective one of the first engine and the second engine to an ON state when the received one or more engine operational parameters indicate that the engine is in an OFF state.

8. The control system of claim 1, wherein the propulsion control unit is configured to transmit an engine operating signal in response to the second user input to switch the respective one of the first engine and the second engine to an OFF state when the received one or more engine operational parameters indicate that the engine is in an ON state.

9. The control system of claim 1, wherein each of the first parity switch and the second parity switch is configured to be actuated for the second time for a second time period less than or equal to a first predefined threshold to provide a second user input for initiating automatic cranking of the respective one of the first engine and the second engine.

10. The control system of claim 1, wherein each of the first parity switch and the second parity switch is configured to be actuated for the second time for a second time period that is greater than a first predefined threshold and less than or equal to a second predefined threshold to provide a second user input for initiating manual cranking of the respective one of the first engine and the second engine.

11. The control system of claim 1, wherein the operator console includes a display unit, and wherein the operator console is configured to:

receive the one or more operational parameters associated with each of the first engine and the second engine from the respective first engine control unit and the second engine control unit via the propulsion unit;

receive one or more transmission parameters associated with one or more of a first transmission connected with the first engine and a second transmission connected with the second engine from the propulsion unit;

receive one or more feedback signals in response to the first user input and the second user input from the respective first engine control unit and the second engine control unit via the propulsion unit; and display, on the display unit, one or more of the received operational parameters, transmission parameters and the feedback signal associated with each of the first engine and the second engine.

12. The control system of claim 1, wherein the network communication channel is an on-board Controller Area Network (CAN) Bus communicatively coupling one or more components of the marine vessel.

13. A method for controlling operations of a marine vessel having a first engine and a second engine operable to propel the marine vessel, the method comprising:

operating a first parity switch to start and stop the first engine and a second parity switch to start and stop the second engine, wherein operating each of the first parity switch and the second parity switch comprising:

actuating the respective first parity switch and the second parity switch for a first time and for a first time period to receive a first user input to activate a remote start/stop control of the respective one of the first engine and the second engine; and actuating the respective first parity switch and the second parity switch for a second time and for a second time period to receive a second user input to switch the respective one of the first engine and the second engine to one of an ON state and an OFF state;

receiving, by an operator console positioned in a deck of the marine vessel, one or more of the first user input and the second user input from the respective first parity switch and the second parity switch;

receiving, by a propulsion control unit from the operator console over a network communication channel, one or more of the first user input and the second user input from each of the first parity switch and the second parity switch;

receiving, by the propulsion control unit, one or more operational parameters associated with each of the first engine and the second engine from a respective first engine control unit associated with the first engine and a second engine control unit associated with the second engine; and transmitting, by the propulsion control unit, one or more engine operating signals for operating each of the first engine and the second engine to the respective first engine control unit and the second engine control unit, the one or more engine operating signals being in response to the one or more first user input and the second user input and are based on the received one or more engine operational parameters.

14. The method of claim 13, wherein the one or more engine operational parameters include one or more of an engine speed and engine operating state.

15. The method of claim 13 further comprising:

receiving, by the propulsion control unit, one or more transmission parameters associated with one or more of a first transmission connected with the first engine and a second transmission connected with the second engine; and transmitting, by the propulsion control unit, one or more engine operating signal based on the received one or more transmission parameters associated with the respective one of the first transmission and the second transmission.

16. The method of claim 13, wherein transmitting the one or more engine operating signals further comprising transmitting, by the propulsion control unit, an engine operating signal in response to the second user input to switch the respective one of the first engine and the second engine to an ON state when the received one or more engine operational parameters indicate that the engine is in an OFF state.

17. The method of claim 13, wherein transmitting the one or more engine operating signals further comprising transmitting, by the propulsion control unit, an engine operating signal in response to the second user input to switch the respective one of the first engine and the second engine to an OFF state when the received one or more engine operational parameters indicate that the engine is in an ON state.

18. The method of claim 13, wherein operating each of the first parity switch and the second parity switch comprising:

actuating the respective first parity switch and the second parity switch for the second time and for a second time period less than or equal to a first predefined threshold to provide a second user input for initiating automatic cranking of the respective one of the first engine and the second engine.

19. The method of claim 13, wherein operating each of the first parity switch and the second parity switch comprising:

actuating the respective first parity switch and the second parity switch for the for the second time and for a second time period that is greater than a first predefined threshold and less than or equal to a second predefined threshold to provide a second user input for initiating manual cranking of the respective one of the first engine and the second engine.

20. The method of claim 13, wherein method further comprising:

receiving, by the operator console from the propulsion unit, the one or more operational parameters associated with each of the first engine and the second engine from the respective first engine control unit and the second engine control unit via the propulsion unit;

receiving, by the operator console from the propulsion unit, one or more transmission parameters associated with one or more of a first transmission connected with the first engine and a second transmission connected with the second engine from the propulsion unit;

receiving, by the operator console from the propulsion unit, one or more feedback signals in response to the first user input and the second user input from the respective first engine control unit and the second engine control unit via the propulsion unit; and displaying, on the display unit associated with the operator console, one or more of the received operational parameters, transmission parameters and the feedback signal associated with each of the first engine and the second engine.

* * * * *